United States Patent [19]

Stevenson

[11] Patent Number: 4,664,180

[45] Date of Patent: May 12, 1987

[54] HEAT RECOVERY UNIT FOR STOVES

[76] Inventor: Robert L. Stevenson, 9003 W. Evans Creek Rd., Rogue River, Oreg. 97537

[21] Appl. No.: 889,291

[22] Filed: Jul. 21, 1986

Related U.S. Application Data

[63] Continuation of Ser. No. 674,785, Nov. 26, 1984, abandoned.

[51] Int. Cl.[4] ..... F28G 1/08

[52] U.S. Cl. ..... 165/94; 165/95; 165/901

[58] Field of Search ..... 165/94, 95

[56] References Cited

U.S. PATENT DOCUMENTS

| | | | |
|---|---|---|---|
| 933,118 | 9/1909 | Schlosser | 165/DIG. 2 |
| 1,300,416 | 4/1919 | Koenig | 165/DIG. 2 |
| 1,898,596 | 2/1933 | Piatt | 165/95 X |
| 2,064,928 | 12/1936 | Lewis | 165/DIG. 2 |
| 2,109,855 | 3/1938 | Arey et al. | 165/95 |
| 2,233,066 | 2/1941 | Watson | 165/95 |
| 2,895,719 | 7/1959 | Blaskowski | 165/94 X |
| 3,410,335 | 11/1968 | Malmstrom et al. | 165/94 X |
| 3,762,464 | 10/1973 | Takahashi | 165/95 |
| 4,034,482 | 7/1977 | Briscoe | 165/DIG. 2 |
| 4,050,628 | 9/1977 | Konnerth, III | 165/DIG. 2 |
| 4,219,073 | 8/1980 | Talmadge et al. | 165/DIG. 2 |
| 4,276,929 | 7/1981 | Howard | 165/145 |
| 4,342,359 | 8/1982 | Baker | 165/47 |
| 4,562,885 | 1/1986 | Pausch | 165/95 X |

FOREIGN PATENT DOCUMENTS

| | | | |
|---|---|---|---|
| 567066 | 11/1975 | U.S.S.R. | 165/94 |

*Primary Examiner*—Albert W. Davis, Jr.
*Assistant Examiner*—Peggy A. Neils
*Attorney, Agent, or Firm*—Eugene M. Eckelman

[57] ABSTRACT

A casing has a plurality of upright panel-type compartments disposed in spaced relation for allowing flue gases and smoke to circulate therebetween. A blower circulates room air through the compartments and back into the room. A cross shaft is mounted in the casing adjacent the top thereof and extends across the spaces between the compartments. Levers are integrated with the cross shaft and support chains in suspended relation between the compartments. The shaft has a projecting handle which when operated is used to oscillate the chains to knock off soot and creosote from the exterior surfaces of walls of the compartments.

2 Claims, 4 Drawing Figures

HEAT RECOVERY UNIT FOR STOVES

This application is a continuation of application Ser. No. 674,785, filed Nov. 26, 1984, now abandoned.

BACKGROUND OF THE INVENTION

This invention relates to new and useful improvements in heat recovery units for stoves.

It is well known that a good portion of the heat from a stove goes up the chimney and amounts to a heat loss which will vary with the heat transfer efficiency of the stove. Thus, devices have been employed, such as shown in U.S. Pat. No. 1,300,416, for capturing some of the heat that usually escapes up the chimney. Such heat recovery units, while serving to cut down the heat loss up the chimney have the disadvantage that they reduce the chimney temperatures considerably and cause a precipitation of the soot and creosote therein. Such prior devices do not have an efficient and easily manipulated cleaning system and thus a dangerous situation may arise wherein they become plugged and create a hazardous combustion condition.

SUMMARY OF THE INVENTION

According to the present invention and forming a primary objective thereof, a heat recovery unit is provided for stoves that has great efficiency for reducing heat loss and at the same time has improved means for readily cleaning soot and creosote from the interior thereof.

In carrying out the objectives of the invention, a casing is provided having a plurality of upright panel-type compartments therein disposed in spaced relation. This casing is installed in the flue outlet of the stove and flue gases and smoke travel up along the exterior of the compartments for warming the compartments. Blower means force air to be warmed through the compartments for picking up heat from the walls thereof. Cleaning is accomplished by a cross shaft mounted in an upper portion of the casing. This shaft has integral levers thereon from which chains are suspended for hanging down in the spaces between the compartments. Upon rotating the shaft back and forth the chains are swung in oscillating motion to knock off soot and creosote which may have collected on the exterior surfaces of the compartments. The shaft has an exterior handle for easy access.

The invention will be better understood and additional objects and advantages will become apparent from the following description taken in connection with the accompanying drawings.

DETAILED DESCRIPTION OF A PREFERRED EMBODIMENT

Figure 1:
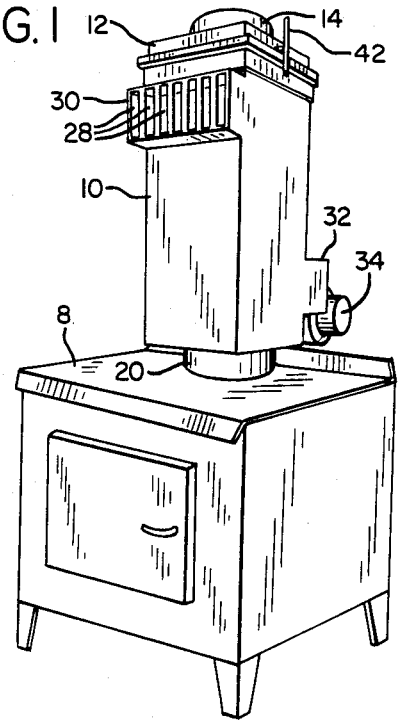
FIG. 1 is a perspective view of a conventional stove and the heat recovery unit of the invention installed thereon.
Figure 2:
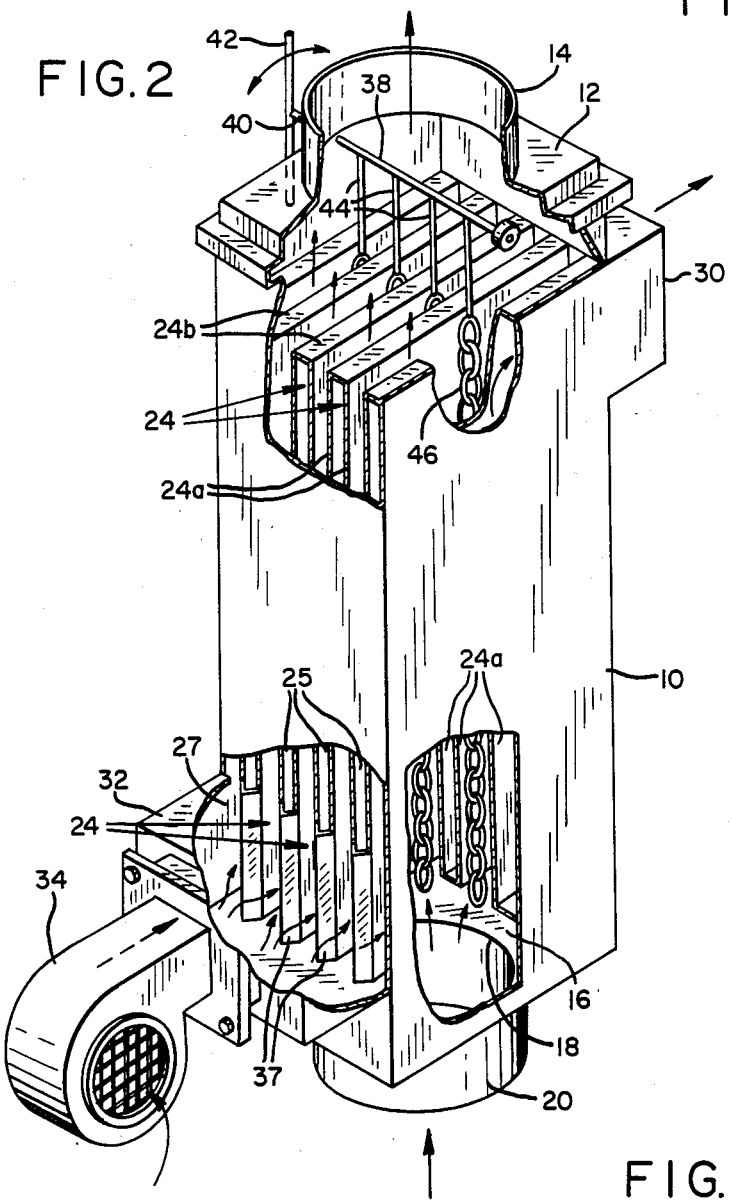
FIG. 2 is an enlarged perspective view of the heat recovery unit of the invention, this view being broken away to show internal structure.

With particular reference to the drawings, the numeral 8 designates a conventional stove and the numeral 10 designates a casing 10 of the present heat recovery unit. This casing is elongated in its vertical height and has a flanged cover 12 which seats down on the top edge of the casing. This cover has an outlet extension 14 at the top for connection to the chimney flue. The bottom wall 16 of the casing has an opening 18 and a depending extension 20 associated with such opening arranged for fitting on the outlet of a stove.

The interior of the casing has a plurality of compartments 24 each formed by a pair of panel-type walls **24*a* at the sides and closed at the top and bottom by walls 24*b*. The ends of the compartments are sealed by securement to the inner wall surfaces of the casing 10. The compartments 24 are disposed in laterally spaced relation to form spaces 25 through which the gases and smoke pass upwardly. Casing 10 has a lower manifold area 26 below the compartments 24 for distribution of the gases and smoke traveling upward through the spaces 25**.

Compartments 24 have inlet openings 27 at a lower rear portion thereof and outlet openings 28 at an upper front portion of the casing. Such casing has a manifold 32 at the rear thereof communicating with at the inlet openings 27. This manifold supports a blower 34 which takes in room air and circulates it by means of the manifold through the compartments 24 and then forcefully discharges it out the outlet openings 28. Openings 28 are provided in the front of a forward casing extension 30. This extension deflects discharged heat from its upward travel to an angular flow substantially straight out into the room. The compartments 24 form a closed path except for their inlet and outlet openings and thus provide a maximum path and heating area for circulating air to be heated. The corners 36 of these compartments are rounded to minimize resistance to heat flow. The portions of the spaces 25 that project down into the manifold 32 are closed by peaked wall portions 37 which in addition to closing such spaces in the manifold efficiently direct air from the blower into the openings 27 of the compartments.

Figure 3:
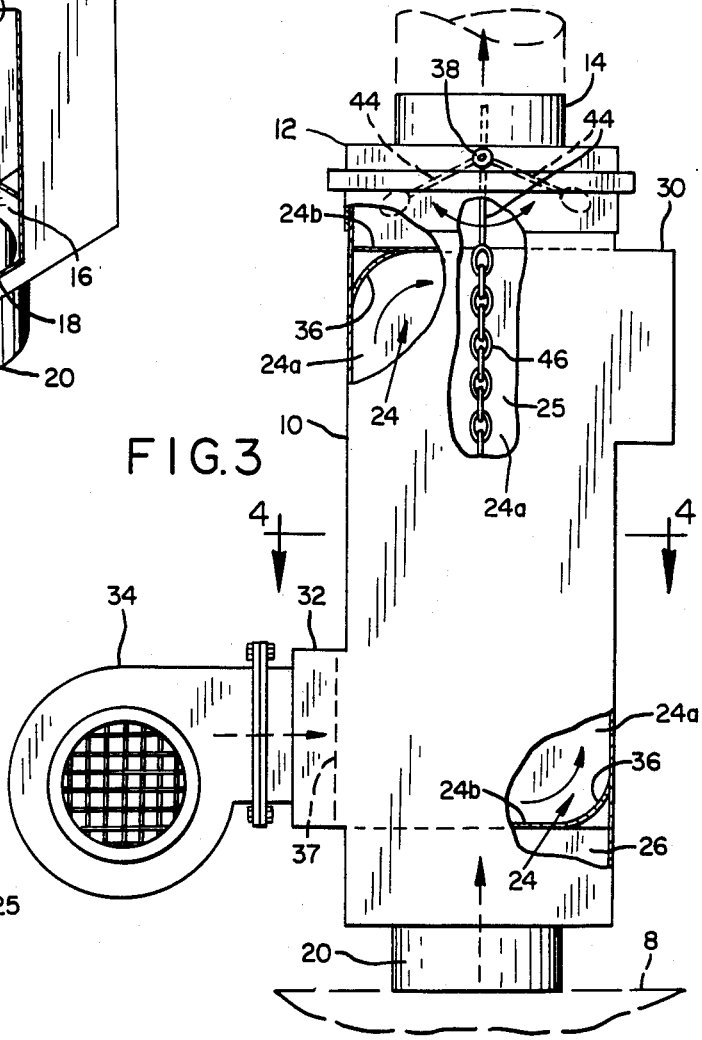
FIG. 3 is a side elevational view of the unit, a portion of this view also being broken away.
Figure 4:
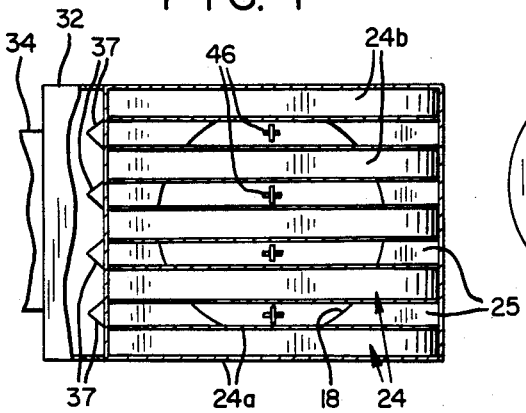
FIG. 4 is a cross sectional view taken on the line 4—4 of FIG. 3.

A shaft 38 is rotatably supported in an upper portion of the casing crosswise of the spaces 25 and above the compartments 24. This shaft has one end 40 projecting from the side of the casing which terminates in a handle 42. The shaft integrally supports a depending lever 44 for each of the spaces 25, and link chains 46 are connected to these levers so as to hang down at least to the bottom of the casing in freely suspended relation. The levers 44 are of sufficient length such that the chains, when oscillated by rotation of the handle 42 between the broken line positions thereof as shown in FIG. 3, will engage all the defining surfaces of the spaces 25.

According to the present invention, a considerable amount of the usual heat loss is captured and blown out into the room. Due to the massive heat exchange area, the draft can be left open 10% to 30%, allowing a smaller fire but at the same time receiving the same amount of heat. By the action of a smaller but hotter fire, most of the flue gases and smoke which are considered pollutants to the atmosphere are combusted.

On the other hand, the present unit is also useful in low fire modes. More particularly, when closing an airtight stove or in other low fire modes, soot and creosote will collect, and the super cooling that is accomplished in the heat recovery unit causes precipitation of the soot and creosote on the walls of the compartments. Such soot and creosote can be easily removed, however, by the action of the cleaning chains. This easy and efficient cleaning apparatus encourages daily or at least regular cleanings and thus promotes safety in the use of stoves. The small amount of soot and creosote which collects within a day or two can be readily shaken loose to fall back into the stove without disturbing the fire.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A heat recovery unit for stoves having an outlet for flue gases and smoke and associated with a chimney, comprising a casing having opposite ends and a bottom opening arranged to be connected to the outlet of a stove and a top opening arranged to be connected to a chimney, a plurality of upright panel-type compartments in said casing having defining walls and opposite ends and disposed in spaced relation for allowing flue gases and smoke to travel through the casing in the spaces between said compartments to heat the walls of said compartments, inlet means adjacent the bottom of said compartments and outlet means adjacent the top of said compartments, blower means arranged to force air to be warmed through said compartments, a cross shaft mounted in said casing adjacent the top thereof and above said compartments, said cross shaft extending across the spaces between said compartments and being disposed approximately centrally between the ends of said casing, operating means on said shaft exterior of said casing for rotating it back and forth, a single depending lever on said cross shaft for each space, said levers being secured on said cross shaft in vertical alignment with said respective spaces, and chains suspended freely from said levers having free ends extending to the bottom of said compartments and swinging loosely in the spaces between said compartments when said shaft is rotated back and forth to knock of soot and creosote from the walls of said compartments, said levers being of a sufficient length such that said chains in their swinging movement also engage the end walls of said spaces.

2. The heat recovery unit of claim 1 wherein the spaces between said compartments at said inlet means are closed by peaked wall portions facing said inlet means to direct forced air into said compartments.

* * * * *